US009809420B2

(12) United States Patent
Fauconnet et al.

(10) Patent No.: US 9,809,420 B2
(45) Date of Patent: Nov. 7, 2017

(54) COMPENSATORY MEASURE FOR LOW OVERHEAD OR LOW PIT ELEVATOR

(71) Applicant: Otis Elevator Company, Farmington, CT (US)

(72) Inventors: Aurelien Fauconnet, Isdes (FR); Etienne Delachatre, Saint Benoit (FR)

(73) Assignee: OTIS ELEVATOR COMPANY, Farmington, CT (US)

( * ) Notice: Subject to any disclaimer, the term of this patent is extended or adjusted under 35 U.S.C. 154(b) by 204 days.

(21) Appl. No.: 14/430,842

(22) PCT Filed: Sep. 25, 2012

(86) PCT No.: PCT/IB2012/002294

§ 371 (c)(1),
(2) Date: Mar. 24, 2015

(87) PCT Pub. No.: WO2014/049387

PCT Pub. Date: Apr. 3, 2014

(65) Prior Publication Data

US 2015/0251876 A1 Sep. 10, 2015

(51) Int. Cl.
*B66B 5/00* (2006.01)
*B66B 5/18* (2006.01)

(52) U.S. Cl.
CPC ..... *B66B 5/0068* (2013.01); *B66B 5/18* (2013.01)

(58) Field of Classification Search
CPC ..... B66B 5/0068; B66B 5/18; B66B 5/0062
USPC ..... 187/357, 356
See application file for complete search history.

(56) References Cited

U.S. PATENT DOCUMENTS 7,475,756 B2 1/2009 Maury et al.
7,650,969 B2 * 1/2010 Monzon ..... B66B 5/06 187/300
2002/0134624 A1 9/2002 Sasaki
2005/0241886 A1 11/2005 Marti et al.
(Continued)

FOREIGN PATENT DOCUMENTS

CN 1448329 A 10/2003
CN 1167596 C 9/2004
(Continued)

OTHER PUBLICATIONS

Chinese Office Action and Search report for application CN 201280076016, dated Apr. 1, 2016, 7 pages.
(Continued)

*Primary Examiner* — William E Dondero
*Assistant Examiner* — Diem Tran
(74) *Attorney, Agent, or Firm* — Cantor Colburn LLP

(57) ABSTRACT

A safety system for an elevator is provided including a safety brake. The safety brake is operatively connectable to one of an elevator car or a counterweight. The safety brake includes a trigger configured to engage the safety when actuated. An actuation device is configured to be mounted to a guide rail. The actuation device includes an actuator movable between a first position and a second position. The actuation device is configured to not actuate the trigger of the safety brake when the actuator is in the first position. The actuation device is configured to actuate the trigger of the safety brake when the actuator is in the second position by physically contacting the trigger.

21 Claims, 7 Drawing Sheets

(56) References Cited

U.S. PATENT DOCUMENTS

| | | | | |
|---|---|---|---|---|
| 2007/0170004 | A1* | 7/2007 | Ito | B66B 5/00 187/254 |
| 2010/0038184 | A1* | 2/2010 | Emmerich | B66B 17/34 187/288 |
| 2010/0163346 | A1 | 7/2010 | Coquerelle et al. | |
| 2014/0116811 | A1* | 5/2014 | Aulanko | B66B 5/0068 187/359 |
| 2015/0041256 | A1* | 2/2015 | Okada | B66B 5/0031 187/254 |

FOREIGN PATENT DOCUMENTS

| | | | | | |
|---|---|---|---|---|---|
| CN | 101027239 | A | | 8/2007 | |
| CN | 101072723 | A | | 11/2007 | |
| CN | 101472825 | A | | 7/2009 | |
| EP | 1350753 | B1 | | 10/2003 | |
| FR | 2977881 | A1 | * | 1/2013 | B66B 5/0062 |
| JP | H11199150 | A | | 7/1999 | |
| JP | 2005239329 | A | * | 9/2005 | B66B 5/0068 |
| JP | 2006502065 | A | | 1/2006 | |
| JP | 2009286525 | A | | 12/2009 | |
| WO | 2008004022 | A1 | | 1/2008 | |

OTHER PUBLICATIONS

Extended European Search Report for Application No. EP12885366 dated Aug. 25, 2016; 11 pgs.

Notification of Transmittal of the International Search Report and the Written Opinion of the International Searching Authority, or the Declaration; PCT/IB2012/002294; dated Apr. 30, 2013; pp. 1-11.

EP Communication Pursuant to Article 94(3) EPC; EP Application No. 12 885 366.0/1731; dated: Jun. 6, 2017; pp. 1-6.

* cited by examiner

COMPENSATORY MEASURE FOR LOW OVERHEAD OR LOW PIT ELEVATOR

BACKGROUND OF THE INVENTION

Embodiments of this invention generally relate to elevator systems, and more particularly, to improving the safe operation of low pit or low overhead elevator systems by limiting movement of elevator cars and counterweights when respective hoistways are accessed.

Traditionally, elevator systems required hoistways with significant spaces below the bottom elevator landing, also known as pits, to allow access to maintenance personal and to house various components of the systems. Similarly, large overhead spaces were also required to allow a mechanic to service various components at the top of the hoistway from the top of an elevator car. Recently, elevator systems having either low pits and/or low overhead areas have become more common. Reducing the depth of the pit or the height of the overhead allows smaller hoistways to be used, thereby allowing for lower construction costs, more flexibility of design, and reduced impact on construction, among other benefits. However, low pit/low overhead elevator systems also present additional challenges. Low pit/low overhead systems are typically made possible by allowing elevator cars to come much closer to the top and/or bottom of the hoistways during normal operation. This creates a challenge when system components (drives, controllers, machines, brakes, etc.) located in the hoistway need to be serviced. According to most elevator codes, a minimum safe distance must be present between the top of the elevator car and the top of the hoistway when maintenance personnel are present in the hoistway. Similar requirements are present related to pit depth. In current low pit/low overhead elevator systems, these requirements have been addressed using separate devices to physically limit the travel of the cars in order to provide a safety refuge space for a person in the pit or on top of the car. While effective, the use of two separate devices can increase the cost of the overall system.

SUMMARY OF THE INVENTION

According to an exemplary embodiment of the invention, a safety system for an elevator is provided including a safety brake. The safety brake is operatively connectable to one of an elevator car or a counterweight. The safety brake includes a trigger configured to engage the safety when actuated. An actuation device is configured to be mounted to a guide rail. The actuation device includes an actuator movable between a first position and a second position. The actuation device is configured to not actuate the trigger of the safety brake when the actuator is in the first position. The actuation device is configured to actuate the trigger of the safety brake when the actuator is in the second position by physically contacting the trigger.

Alternatively, in this or other embodiments of the invention, the actuation device is configured to actuate the trigger of the safety brake when the actuator is in the second position by physically contacting the trigger when the safety brake moves past the actuation device.

Alternatively, in this or other embodiments of the invention, the actuator is operably coupled to a weight. The weight is selectively coupled to a portion of the actuation device when the actuator is in the first position. The weight is uncoupled from the portion of the actuation device when the actuator is in the second position.

Alternatively, in this or other embodiments of the invention, the force of gravity on the weight moves the actuator from the first position to the second position.

Alternatively, in this or other embodiments of the invention, the weight is selectively coupled to a portion of the actuation device using an electromagnet.

Alternatively, in this or other embodiments of the invention, wherein the guide rail is one of a car guide rail and a counterweight guide rail.

Alternatively, in this or other embodiments of the invention, wherein the actuator is an electromagnet having a permanent magnet core.

Alternatively, in this or other embodiments of the invention, the weight is uncoupled from the portion of the actuation device when power is removed from the actuator.

Alternatively, in this or other embodiments of the invention, a triggering member pivotally coupled the weight to a bracket of the actuation device.

Alternatively, in this or other embodiments of the invention, the triggering member includes a first arm for coupling the weight to the bracket. The triggering member includes a second arm arranged at an angle to the first arm. The second arm engages the trigger of the safety brake.

Alternatively, in this or other embodiments of the invention, when the actuator is in the first position, the triggering member is retracted into the actuation device. When the actuator is in the second position, the triggering member extends from the actuation device.

Alternatively, in this or other embodiments of the invention, the actuation device includes a first contactor and a second contactor.

Alternatively, in this or other embodiments of the invention, a first end of the weight engages the first contactor when the actuator is in the first position. A second end of the weight engages a second contactor when the actuator is in the second position.

According to another embodiment of the invention, a

An elevator system is provided including an elevator hoistway having an upper end and a lower end. An elevator car is configured to move within the elevator hoistway along at least one car guide rail. A counterweight is coupled to the elevator car. The counterweight is configured to move within the hoistway along at least one counterweight guide rail. A safety brake is operatively connectable to one of the elevator car or the counterweight. The safety brake includes a trigger configured to engage the safety brake when actuated. An actuation device is configured to be mounted to one of the car guide rail and the counterweight guide rail. The actuation device includes an actuator movable between a first position and a second position. The actuation device is configured to not actuate the trigger of the safety brake when the actuator is in the first position. The actuation device is configured to actuate the trigger of the safety brake when the actuator is in the second position by physically contacting the trigger.

Alternatively, in this or other embodiments of the invention, the actuator is in the first position when the elevator system is in a normal mode. The actuator is in the second position when the elevator system is in an inspection mode.

Alternatively, in this or other embodiments of the invention, the actuator is operably coupled to a weight. The weight is selectively coupled to a portion of the actuation device when the actuator is in the first position. The weight is uncoupled from the portion of the actuation device when the actuator is in the second position.

Alternatively, in this or other embodiments of the invention, the weight is selectively coupled to the portion of the actuation device using an electromagnet.

Alternatively, in this or other embodiments of the invention, the actuator is an electromagnet having a permanent magnet core.

Alternatively, in this or other embodiments of the invention, the weight is uncoupled from the portion of the actuation device when power is removed from the actuator.

Alternatively, in this or other embodiments of the invention, when the elevator system is placed in an inspection mode, power is removed from the actuator.

Alternatively, in this or other embodiments of the invention, the elevator system includes a first actuation device mounted to the car guide rail and a second actuation device mounted to the counterweight guide rail.

According to yet another embodiment of the invention, a.

A method of using an actuation device in an elevator system to stop an elevator car or counterweight from moving beyond a desired location is provided including placing the elevator system in an inspection mode. Power is removed from an actuator of the actuation device such that the actuator moves from a first position to a second position. A safety brake is activated by physically contacting a trigger of the safety brake as the safety brake passes the actuation device.

BRIEF DESCRIPTION OF THE DRAWINGS

The foregoing and other features, and advantages of the invention are described in the following detailed description taken in conjunction with the accompanying drawings in which.

The detailed description of the invention describes exemplary embodiments of the invention, together with some of the advantages and features thereof, by way of example with reference to the drawings.

DETAILED DESCRIPTION OF THE INVENTION

Figure 1:
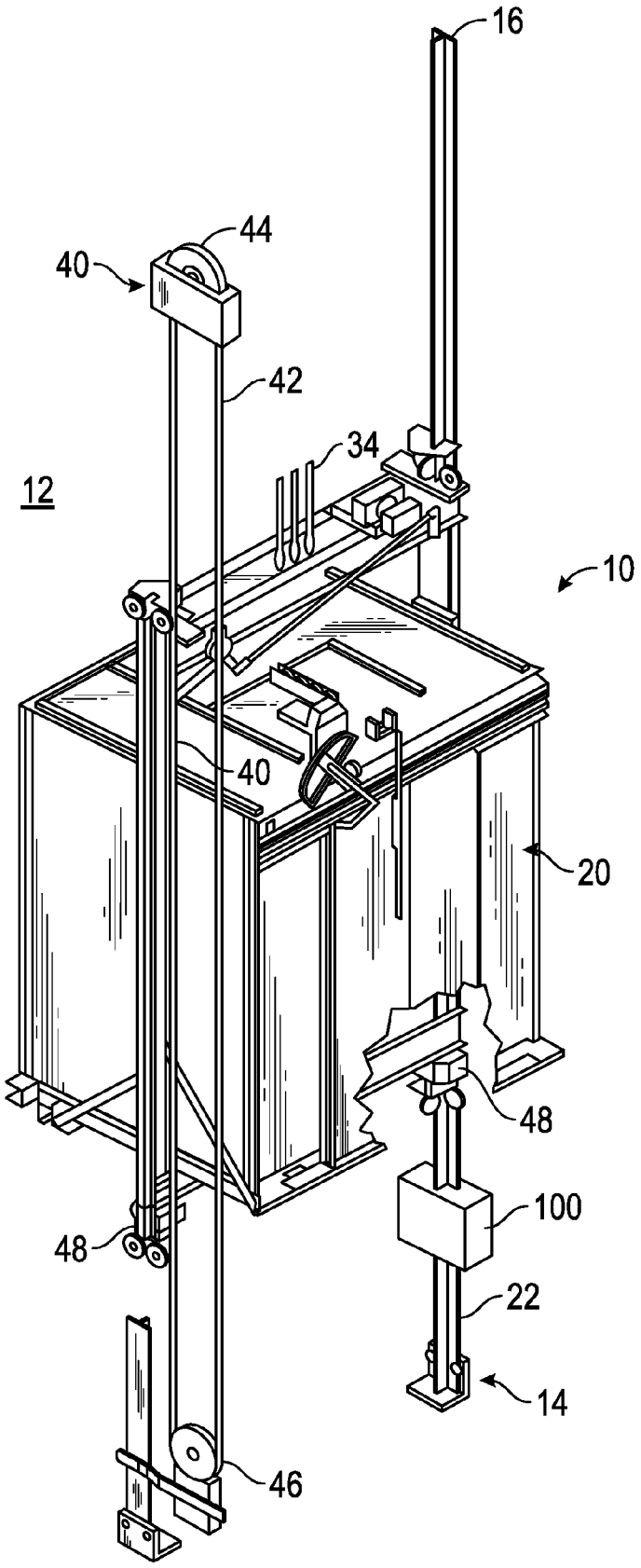
FIG. 1 is a perspective view of an exemplary elevator system.
Figure 2:
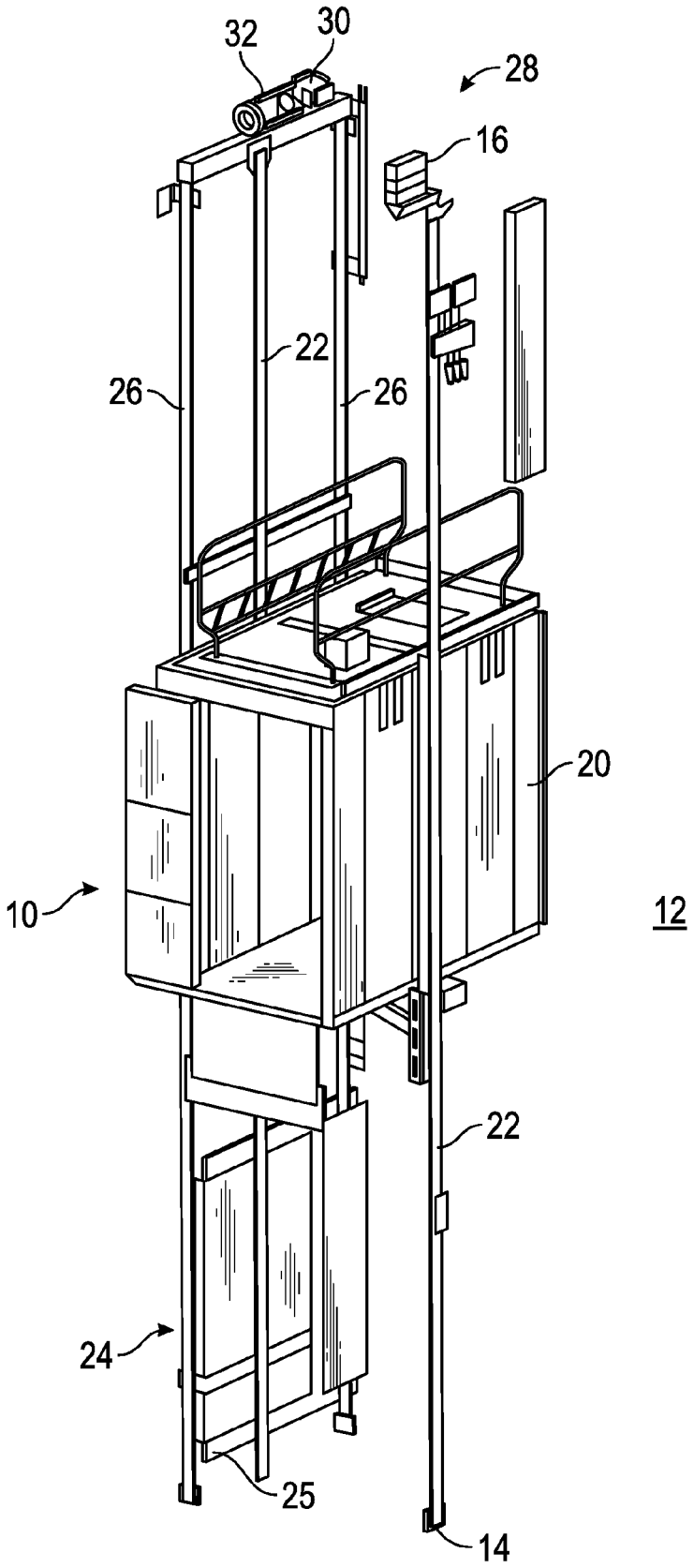
FIG. 2 is a perspective view of an exemplary elevator system.

Referring now to FIGS. 1 and 2, an exemplary elevator system 10 is illustrated including an elevator car 20 movable along car guide rails 22 in a known manner. In one example, a machine room-less elevator system 10 allows the elevator car 20 to move essentially along the entire length of a hoistway 12 between a lower end 14 of the hoistway and an upper end 16 of the hoistway 12. A drive system 28 moves the elevator car 20 in the hoistway 12. The drive system 28 may include a drive motor 30 and a drive sheave 32. The drive sheave 32 may be coupled to the drive motor 30 such that rotational output of the drive motor 30 is transmitted to the drive sheave 32. One or more tension ropes 34 connect the elevator car 20 to a counterweight 24 movable along counterweight guide rails 26. The tension ropes 34 may be belts, cables, ropes, or any other known element for coupling a car 20 and a counterweight 24. The rotational output of the drive motor 30 is transmitted to the elevator car 20 via the tension ropes 34 guided around the drive sheave 32. Although a particular elevator system is illustrated and described in the disclosed embodiment, other configurations and/or systems, such as ropeless or hydraulic systems are within the scope of the present invention.

A governor device 40 controls movement of the elevator car 20 by preventing the car 20 from moving beyond a set maximum speed. The exemplary governor device 40 includes a rope 42 that travels with the car 20 as the car 20 moves along the car guide rails 22. A governor sheave 44 and a tension sheave 46 are located at opposite ends of a loop formed by the governor rope 42. The illustrated governor device 40 operates in a known manner. In the event that the elevator car 20 moves too fast, the governor device 40 exerts a braking force on the governor sheave 44. The braking force causes the governor rope 42 to pull upon a mechanical linkage to activate the safety brakes 48 shown diagrammatically in FIG. 1. In this example, the safety brakes 48 apply a braking force against the car guide rails 22 to prevent further movement of the elevator car 20. A variety of safety brakes 48 for this purpose are known. Connecting rods (not shown) may be arranged in a known manner above the car roof and/or below the car floor to synchronize the operation of the safety brakes 48 cooperating with respective car guide rails 22 disposed on both sides of the car 20.

The arrangement illustrated in FIG. 1 includes a safety device 100 according to various embodiments of the invention. Further according to various embodiments of the inventions, the safety device 100 may be positioned at a selected height within the hoistway 12, and it may interact with at least one of the safety brakes 48 under selected conditions to prevent the elevator car 20 from moving too close to the upper end 16 of the hoistway 12, the lower end 14 of the hoistway 12, or both. Only one safety device 100 is schematically illustrated in FIG. 1, but multiple safety devices 100 may be strategically placed within a hoistway 12.

Figure 3:
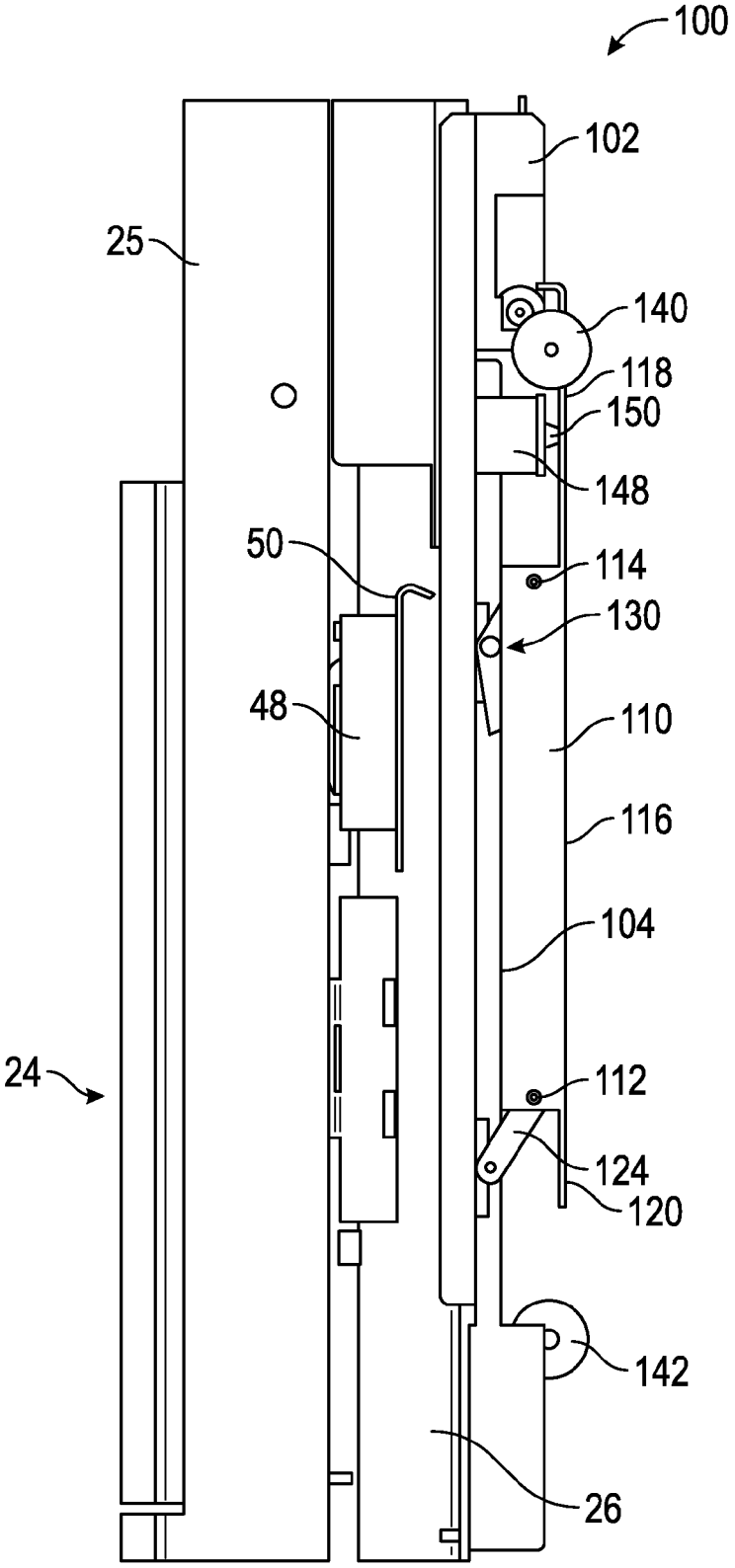
FIG. 3 is a side view of a safety device according to an embodiment of the invention.

While the governor device 40 operates depending on a speed of the elevator car 20, the safety device 100 operates depending on a vertical position of the elevator car 20 or the counterweight 24 in the hoistway 12. FIG. 3 depicts an exemplary safety device 100 according to an embodiment of the invention in more detail. The exemplary safety device 100 depicted in FIG. 3 is configured to maintain a desired amount of clearance between the bottom of the counterweight 24 and the pit 14 of the hoistway 12. At the same time, a desired amount of clearance is maintained between a top of the elevator car 20 and an overhead surface 16, for example the top of the hoistway 12. Such clearance provides adequate space to accommodate an individual, such as a mechanic or a technician on top of the elevator car during a maintenance or inspection procedure for example, in an elevator system 10 having a low overhead.

The safety device 100 is an actuation device configured to be mounted to a guide rail, such as either the counterweight guide rail 26 or the car guide rail 22 for example. The actuation device includes an actuator movable between a first position and a second position. When the actuator is in a first position, the actuation device is not configured to engage a safety brake mounted to either the car or the counterweight. When the actuator is in the second position, gravity causes the actuation device to pivot to a second position. In the second position, the actuation device is configured to trip the safety brake mounted to either the car or the counterweight. As the car or counterweight travels past the actuation device, a portion of the actuation device will physically contact a trigger of the safety brake, causing the safety brake to engage the guide rail it is operably connected to.

For low overhead applications, the safety device 100 may include a bracket 102 mounted to a counterweight guide rail 26 near the lower end 14 of the hoistway 12. According to various embodiments of the invention, the safety device 100 may be mounted to the counterweight guide rail 26 about 2 meters from the lower end 14 of the hoistway 12. A weight 110 is mounted to the surface 104 of the bracket 102 and is movable between a first position and a second position. In one embodiment, a connector 124 couples a first end 112 of the weight 110 to the bracket 102 and a triggering member 130 couples a second, opposite, end 114 of the weight 110 to the bracket 102. The triggering member 130 may include a first arm 132 and a second arm 134 that is angled relative to the first arm 132 as shown in the exemplary safety device depicted in FIG. 4. Alternatively, the triggering member 130 may have only a single arm pivotally mounted in the middle. In yet another embodiment, the triggering member 130 may be a magnetic latch. When the weight 110 is in a first position, shown in FIG. 3 as an upper position, the triggering member 130 is retracted, or flush relative to the bracket 102. When the weight 110 is in the second position, shown in FIG. 4 as a lower position, the triggering member 130 is in an extended position that is not flush with the bracket 102. Thus, a portion of the triggering member 130, such as the second arm 134 for example, selectively interacts with a safety brake 48 mounted to the frame 25 of the counterweight 24 to prevent movement of the counterweight 24, and therefore the elevator car 20, beyond a desired location.

Additionally, a first contactor 140 and a second contactor 142 may be mounted to the bracket 102. The first contactor 140 and the second contactor 142 are spaced apart by a distance greater than the length of the weight 110. An actuator 148 is mounted to the bracket 102 near the first contactor 140. An actuation device 150, configured to engage the actuator 148, is mounted to a portion of the weight 110 116 adjacent the first end 112. In one embodiment, the actuator 148 is an electromagnet having a permanent magnet core, and the complementary actuation device 150 is a metal plate or alternatively a magnet. Power may be applied to the actuator 148 to selectively decouple the actuation device 150.

During normal elevator operation, the actuator 148 and the actuation device 150 are engaged, as shown in FIG. 3. The connection between the actuator 148 and the actuation device 150 retains the weight 110 in the first position. When the weight 110 is in the first position, an upper portion 118 of the weight 110 contacts the first contactor 140 to indicate that the elevator system 10 is in a normal operation mode. When power is applied to the actuator 148, the magnetic field generated by the permanent magnet is cancelled, causing the actuation device 150 to decouple from the actuator 148 and the weight 110 drops via gravity into the second position. In the second position, a lower portion 120 of the weight 110 engages the second contactor 142 to indicate that the elevator system 10 is in an inspection mode.

Figure 4:
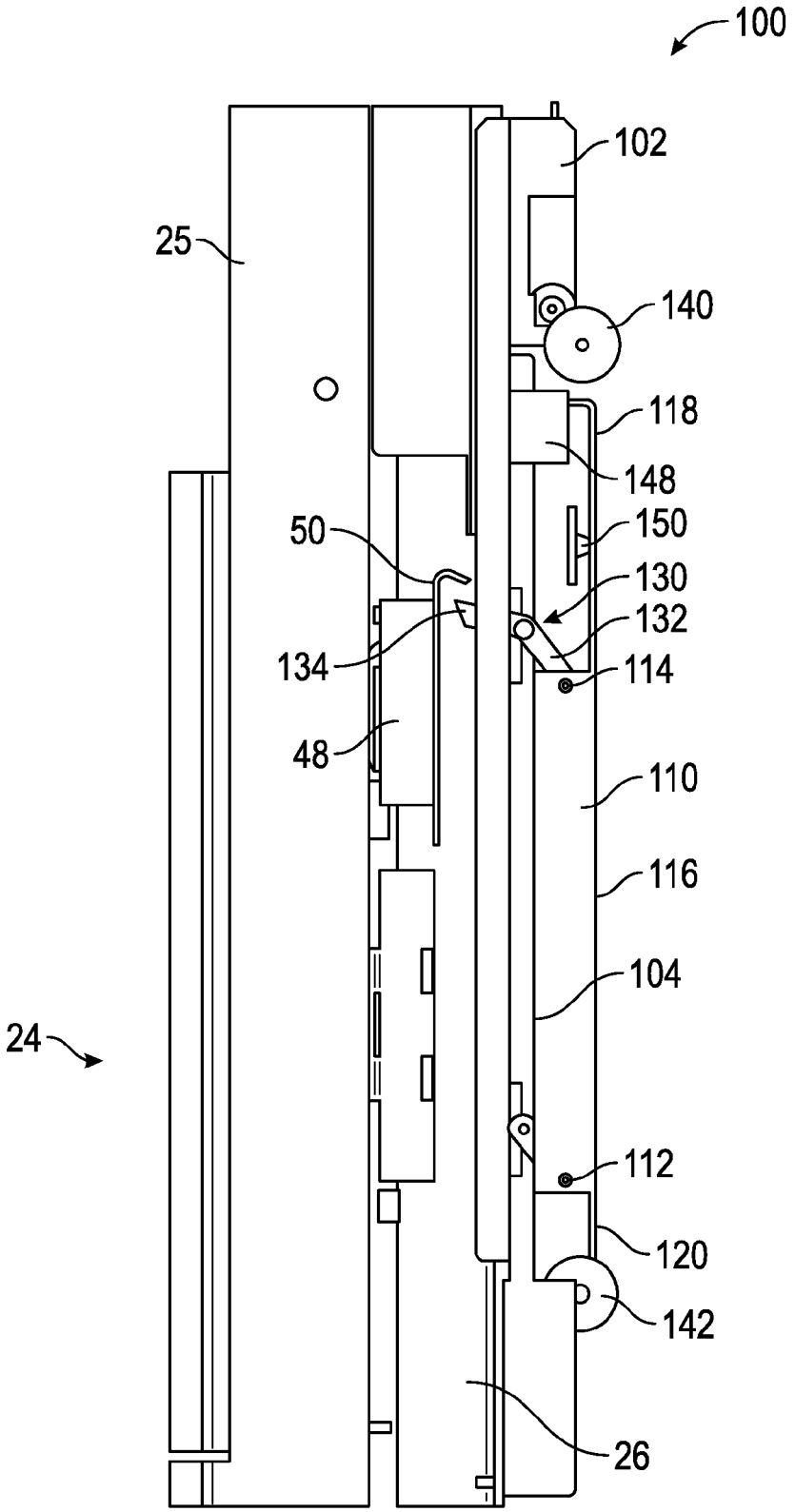
FIG. 4 is a side view of the safety device illustrated in FIG. 3 according to an embodiment of the invention.

During normal elevator operation, the triggering member 130 is maintained in a retracted position so that the elevator car 20 is free to move along the entire range of the hoistway 12. When the elevator is placed in inspection mode, the triggering member 130 is pivoted into an extended position, as shown in FIG. 4. In this position, the second arm 134 of the triggering member 130 extends through the bracket 102 and engages a portion of the safety brake 48, such as a safety activator 50 for example, to stop movement of the counterweight 24 beyond a height which is dictated by the location of the safety device 100 and the corresponding interaction with the safety brakes 48. Accordingly, the safety device 100 prevents the counterweight and the elevator car 20 from moving beyond a desired position along the guide rails 22, 26 when the system is in inspection mode, while allowing the car 20 to travel the entire length of the guide rails 22, 26 when system is in a normal mode.

Figure 5:
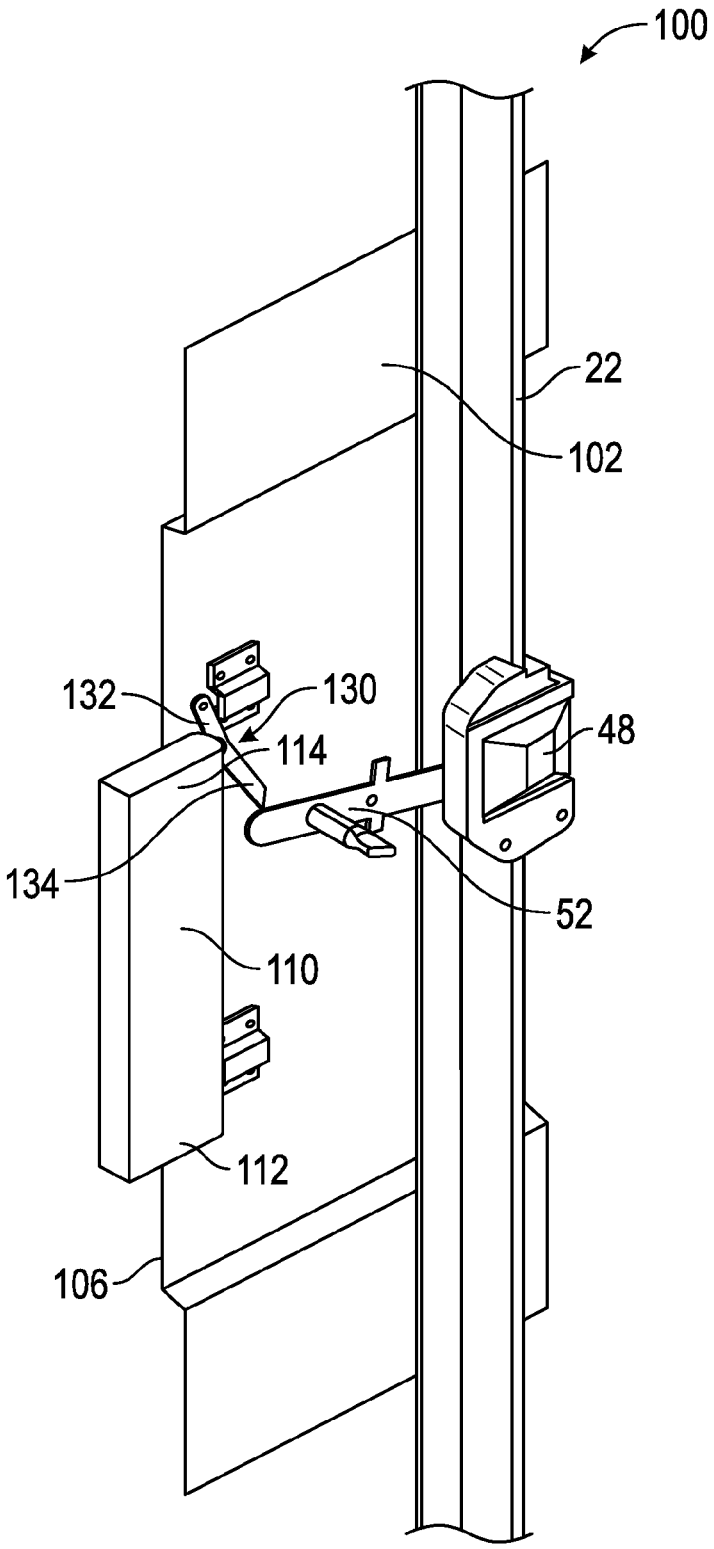
FIG. 5 is a perspective view of another safety device according to an embodiment of the invention.
Figure 6:
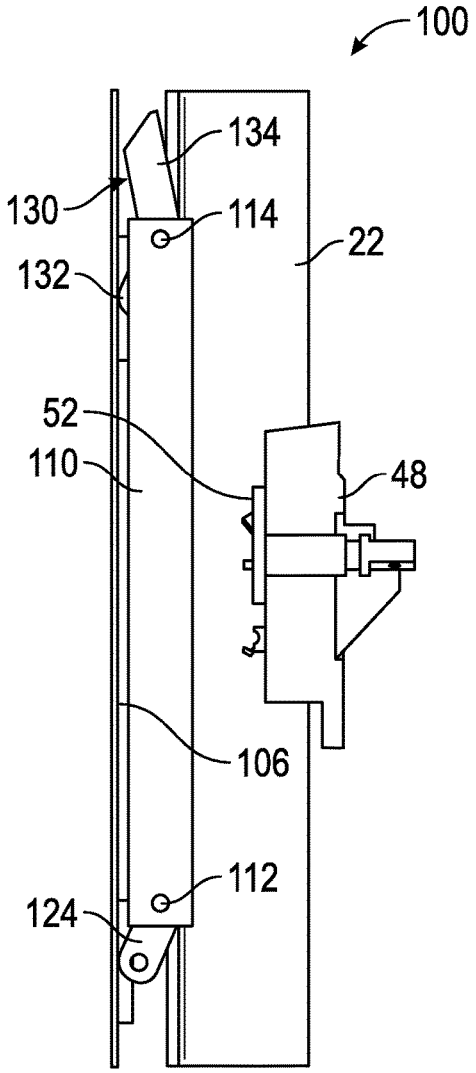
FIG. 6. is a side view of the safety device illustrated in FIG. 5 according to an embodiment of the invention.
Figure 7:
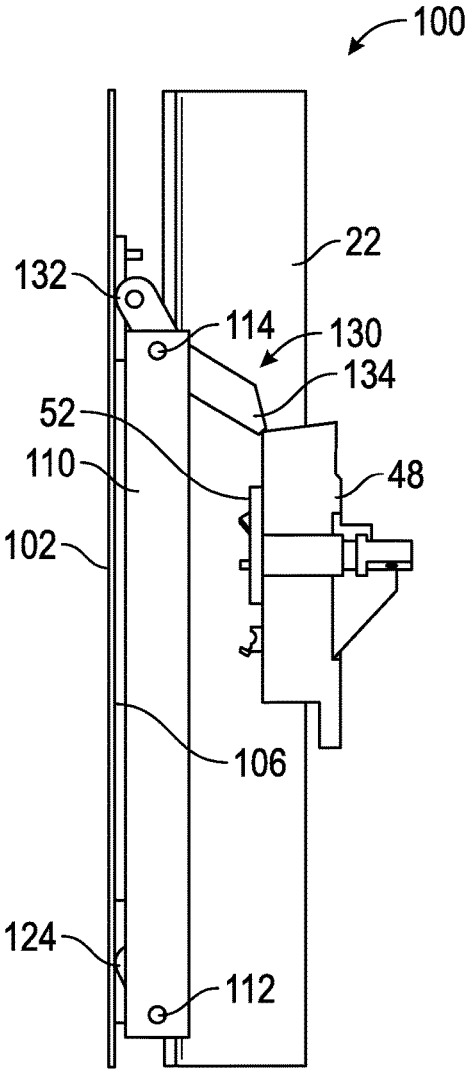
FIG. 7 is a side view of the safety device illustrated in FIG. 5 according to an embodiment of the invention.

According to various other embodiments of the invention, such as the exemplary embodiment illustrated in FIGS. 5-7, the safety device 100 may be configured to maintain a desired amount of clearance between the bottom of the elevator car 20 and the pit 14 of the hoistway 12, such as in an elevator system 10 having a low pit for example. The bracket 102 of the safety device 100 is similarly mounted to a surface of a car guide rail 22. In one embodiment, the safety device 100 is mounted to the car guide rail 22 at a distance of about two meters from the lower end 14 of the hoistway 12. The weight 110 is pivotally mounted to the bracket 102 with both a connector 124 and a triggering member 130. In one embodiment, the weight 110 is mounted to the same surface 106 of the bracket 102 as the car guide rail 22 in a laterally offset position. Because the weight 110 is offset from the car guide rail 22, and therefore the safety block 48 mounted to the car 20, a safety bar linkage 52 may extend from the safety block 48 in the direction of the weight 110. Weight 110 in FIGS. 5-6 is held in the first position using an actuator 148 and an actuation device 150, similar to that described above with reference to FIG. 3.

When the weight 110 is moved from a first position to a second position, the second arm 134 of the triggering member 130 extends from the bracket 102 in the direction of the safety bar linkage 52. In one embodiment, the triggering member 130 extends perpendicularly from the bracket 102. In this extended stopping position, the second arm 134 engages the safety bar linkage 52 to stop movement of the elevator car 20 beyond a predetermined location. In one embodiment, an elevator system 10 may include a first safety device 100 mounted to the counterweight guide rail 26 and a second safety device 100 mounted to the car guide rail 22. By placing multiple safety devices 100 within a hoistway 12, an adequate clearance may be maintained between the elevator car 20 and the lower and upper ends 14, 16 of the hoistway 12.

To activate the safety device 100, a person, for example a mechanic, is able to place the elevator system in an "inspection mode," such as by activating a switch on a landing door (not shown) or by opening a foldable balustrade (not shown) on top of the elevator car 20. In one embodiment, the elevator system 10 may also include an emergency button in either the pit and/or on the car top for instances when the switch on the landing door or the foldable balustrade failed to activate the safety device 100. When the system 10 is placed in "inspection mode," power may be applied to the actuator 148, such that the actuation device 150 is no longer attracted to the actuator 148. Gravity will then cause the weight 110 to pivot about the bracket 102 from the first position to the second position. The movement of the weight 110 will then cause the triggering member 130 to move from a retracted position to an extended position. As the elevator car 20 and counterweight 24 move within the hoistway, the second arm 134 of the triggering member 130 is configured to engage a portion of the safety block 48 to prevent further movement of either the elevator car 20 or the counterweight 24.

Figure 8:
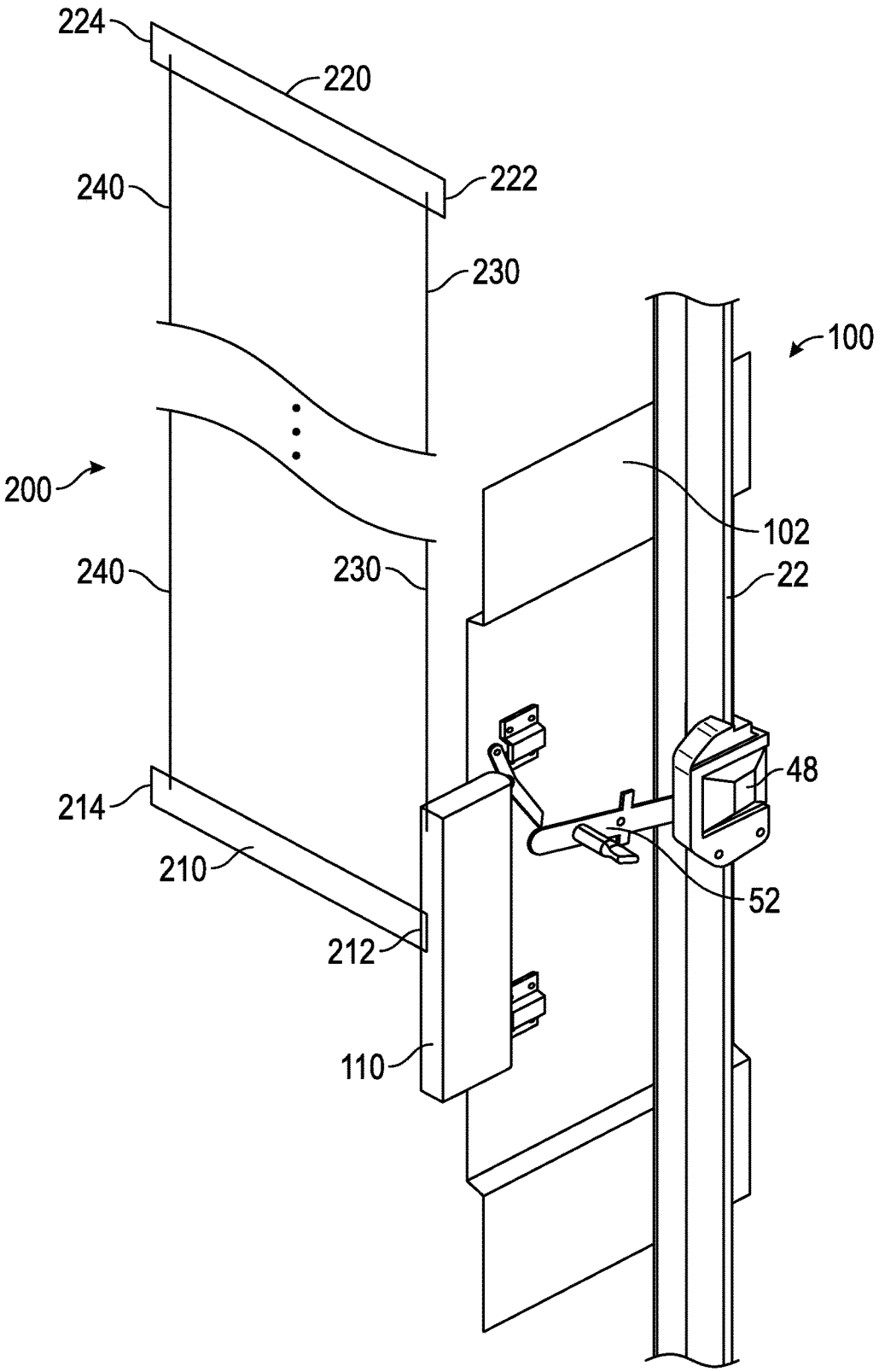
FIG. 8 is a perspective view of a device for resetting the safety device according to an embodiment of the invention.

Once a mechanic has completed work in the hoistway 12, the safety device 100 may be reset, thereby returning the elevator to normal operation. In an exemplary embodiment of the invention, illustrated in FIG. 8, the elevator system 10 includes a reset device 200 including a first lever 210 is pivotally mounted at a first end 212 to the weight 110. A second lever 220 is provided near the top 16 of the hoistway 12 and is oriented parallel to the first lever 210. A first cable 230 extends from the weight 110 to a first end 222 of the second lever. A second cable 240 extends from the free end 214 of the first lever 210 to the second end 224 of the second lever 220. Movement of the second cable 240 causes a corresponding movement of the first and second lever 210, 220 and the first cable 230 in a manner that controls the position of the weight. For example, a downward force on the second cable 240 causes the first cable 230 to pull the weight 110 upwards so that the actuator 148 and the actuation device 150 may couple.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A safety system for an elevator, comprising:

a safety brake, operatively connectable to one of an elevator car or a counterweight, the safety brake comprising a safety linkage configured to engage the safety brake when actuated;

a safety device, configured to be mounted to a guide rail, the safety device including an actuator and an actuation device, the actuation device being movable between a first position and a second position, wherein when the actuation device is in the first position, the safety device does not actuate the safety linkage of the safety brake, and when the actuation device is in the second position, the safety device is configured to actuate the safety linkage of the safety brake by physically contacting the safety linkage, wherein gravity causes the actuation device to move between the first position and the second position.

2. The safety system according to claim 1, wherein the actuation device is configured to actuate the safety linkage of the safety brake by physically contacting the safety linkage as the safety brake moves past the actuation device.

3. The safety system according to claim 1, wherein the actuation device further comprises a weight, and when the actuation device is in the first position, the actuator is operably coupled to the weight, and when the actuation device is in the second position, the actuator is uncoupled from the weight.

4. The safety system according to claim 3, wherein the weight is selectively coupled to the actuator using an electromagnet.

5. The safety system according to claim 1, wherein the guide rail is one of a car guide rail and a counterweight guide rail.

6. The safety system according to claim 1, wherein the actuator is an electromagnet having a permanent magnet core.

7. The safety system according to claim 1, wherein the actuation device is uncoupled from the actuator when power is removed from the actuator.

8. The safety system according to claim 1, wherein the safety device further comprises a bracket, a weight, and a triggering member, the triggering member pivotally coupling the weight to the bracket of the safety device.

9. The safety system according to claim 8, wherein the triggering member includes a first arm for coupling the weight to the bracket and a second arm arranged at an angle to the first arm for engaging the safety linkage of the safety brake.

10. The safety system according to claim 9, wherein when the weight is in the first position, the triggering member is retracted into the safety device, and when the weight is in the second position, the triggering member extends from the safety device.

11. The safety system according to claim 1, wherein the safety device includes a first contactor and a second contactor.

12. The safety system according to claim 11, wherein a first end of the actuation device engages the first contactor when the actuation device is in the first position and a second end of the actuation device engages the second contactor when the actuation device is in the second position.

13. An elevator system comprising:

an elevator hoistway having an upper end and a lower end;

an elevator car configured to move within the elevator hoistway along at least one car guide rail;

a counterweight coupled to the elevator car, the counterweight being configured to move within the hoistway along at least one counterweight guide rail;

a safety brake, operatively connectable to one of the elevator car or counterweight, the safety brake comprising a safety linkage configured to engage the safety brake when actuated;

safety device, configured to be mounted to one of the car guide rail or counterweight guide rail, the safety device comprising an actuation device movable between a first position and a second position, wherein when the actuation device is in the first position, the safety device does not actuate the safety linkage of the safety brake, and when the actuation device is in the second position, the safety device is configured to actuate the safety linkage of the safety brake by physically contacting the safety linkage wherein gravity causes the actuation device to move between the first position and the second position.

14. The elevator system according to claim 13, wherein the actuation device is in the first position when the elevator system is in a normal mode and the actuation device is in the second position when the elevator system is in an inspection mode.

15. The elevator system according to claim 14, wherein the safety device further comprises an actuator, and the actuation device includes a weight, wherein the weight is selectively coupled to the actuator is in the first position when the actuation device is in the first position, and the weight is uncoupled from the actuator when the actuation device is in the second position.

16. The elevator system according to claim 15, wherein the weight is selectively coupled to the portion of the actuator using an electromagnet.

17. The elevator system according to claim 16, wherein the actuator is an electromagnet having a permanent magnet core.

18. The elevator system according to claim 17, wherein the weight is uncoupled from the actuator when power is removed from the actuator.

19. The elevator system according to claim 18, wherein the elevator system is placed in an inspection mode, power is removed from the actuator.

20. The elevator system according to claim 13, wherein the elevator system includes a plurality of safety devices including first safety device mounted to the car guide rail and a second safety device mounted to the counterweight guide rail.

21. A method of using a safety device in an elevator system to stop an elevator car or counterweight from moving beyond a desired location comprising:

placing the elevator system in an inspection mode;

removing power from an actuator of the safety device such that an actuation device of the safety device moves from a first position to a second position, wherein the actuation device moves from the first position to the second position via gravity; and activating a safety brake by physically contacting a safety linkage of the safety brake as the safety brake passes the safety device.

* * * * *